US007876050B2

(12) United States Patent
Misawa et al.

(10) Patent No.: US 7,876,050 B2
(45) Date of Patent: Jan. 25, 2011

(54) PLASMA DISPLAY PANEL, AND SUBSTRATE ASSEMBLY OF PLASMA DISPLAY PANEL

(75) Inventors: Tomonari Misawa, Yokohama (JP); Koichi Sakita, Akashi (JP)

(73) Assignee: Hitachi, Ltd., Tokyo (JP)

( * ) Notice: Subject to any disclaimer, the term of this patent is extended or adjusted under 35 U.S.C. 154(b) by 324 days.

(21) Appl. No.: 12/045,051

(22) Filed: Mar. 10, 2008

(65) Prior Publication Data

US 2008/0278419 A1 Nov. 13, 2008

(30) Foreign Application Priority Data

May 9, 2007 (JP) ..... 2007-124718

(51) Int. Cl.
*H01J 17/49* (2006.01)

(52) U.S. Cl. ..... 313/587; 313/586

(58) Field of Classification Search ..... None
See application file for complete search history.

(56) References Cited

U.S. PATENT DOCUMENTS

| | | | | |
|---|---|---|---|---|
| 6,821,616 | B1 | 11/2004 | Sakurai | |
| 7,391,156 | B2 | 6/2008 | Hasegawa et al. | |
| 7,501,763 | B2 | 3/2009 | Hashimoto et al. | |
| 7,511,428 | B2 * | 3/2009 | Nishitani et al. | 313/587 |
| 2005/0206318 | A1 | 9/2005 | Hirota et al. | |
| 2006/0055324 | A1 * | 3/2006 | Hasegawa et al. | 313/587 |
| 2007/0096653 | A1 | 5/2007 | Jeong | |

FOREIGN PATENT DOCUMENTS

| | | |
|---|---|---|
| EP | 1 587 126 | 10/2005 |
| EP | 1 638 127 | 3/2006 |
| EP | 1 780 479 | 5/2007 |
| JP | 2003-022755 | 1/2003 |
| JP | 2005-123172 | 5/2005 |
| JP | 2006-059786 | 3/2006 |
| JP | 2007-254269 | 10/2007 |
| KR | 10-2006-0012563 | 2/2006 |
| KR | 10-2007-0047075 | 5/2007 |
| WO | WO 2005/098890 | 10/2005 |

* cited by examiner

*Primary Examiner*—Ashok Patel
(74) *Attorney, Agent, or Firm*—Antonelli, Terry, Stout & Kraus, LLP.

(57) ABSTRACT

A plasma display panel includes a discharge space between two substrate assemblies opposed to each other, wherein a priming particle-emitting layer containing magnesium oxide crystals to which a halogen element is added in an amount of 1 to 10000 ppm is placed in such a way that the priming particle-emitting layer is exposed to the discharge space.

7 Claims, 4 Drawing Sheets

CROSS-SECTIONAL VIEW
TAKEN ON LINE I-I

CROSS-SECTIONAL VIEW TAKEN ON LINE II-II

CROSS-SECTIONAL VIEW TAKEN ON LINE I-I

PLASMA DISPLAY PANEL, AND SUBSTRATE ASSEMBLY OF PLASMA DISPLAY PANEL

CROSS-REFERENCE TO RELATED APPLICATION

This application is related to Japanese Patent Application No. 2007-124718 filed on May 9, 2007, whose priority is claimed and the disclosure of which is incorporated by reference in its entirety.

BACKGROUND OF THE INVENTION

1. Field of the Invention

The invention relates to a plasma display panel (hereinafter, referred to as PDP) and a substrate assembly of a PDP.

2. Description of the Related Art

FIG. 6 is a perspective view showing a structure of a conventional PDP. The PDP has a structure formed by sticking a front-side substrate assembly 1 and a rear-side substrate assembly 2 to each other. The front-side substrate assembly 1 comprises a front-side substrate 1*a*, which is a glass substrate, and a plurality of display electrodes 3 each composed of a transparent electrode 3*a* and a metal electrode 3*b* and placed on the substrate 1*a*. A dielectric layer 4 covers the display electrodes 3, and further, a protective layer 5, which is a magnesium oxide layer, with a high secondary electron emission coefficient is formed on the dielectric layer 4. In the rear-side substrate assembly 2, a plurality of address electrodes are placed on a rear-side substrate 2*a*, which is a glass substrate, so that the address electrodes cross at a right angle to the display electrodes. Barrier ribs 7 for defining the light emitting regions (for dividing discharge spaces) are formed between neighboring address electrodes 6 and red-, green-, and blue-emitting phosphor layers 8 are formed on the address electrodes 6 in the regions divided by the barrier ribs 7. A discharge gas, a Ne—Xe gas mixture, is introduced in air-tight discharge spaces divided by the barrier ribs and formed between the front-side substrate assembly 1 and the rear-side substrate assembly 2 stuck to each other. It should be noted that the address electrodes 6 are covered with a dielectric layer (not shown) and the barrier ribs 7 and the phosphor layers 8 are formed on the dielectric layer.

Thus, in such a PDP, address discharge is generated by applying voltage between the address electrodes 6 and the display electrodes 3 also serving as a scan electrode, and reset discharge or sustain discharge for display is generated by applying voltage between a pair of display electrodes 3.

Such PDPs are put to practical use in large flat-screen televisions, and in recent years, development of high-resolution display progresses. As the display becomes higher in resolution, the number of pixels increases. The increase of the number of pixels increases time for addressing, which determines cell's lighting/non-lighting. In order to suppress an increase in the time for addressing (address period), it is necessary to shorten a pulse width of voltage for address discharge (also referred to as address voltage). However, since discharge time-lag (time from application of voltage to occurrence of discharge) varies, discharge can fail to occur when the pulse width of address voltage is too small. In this case, addressed cells do not correctly light in a display period during which lighting of the addressed cells is supposed to be sustained. This causes a problem of deterioration of image quality.

As a means for improving discharge time-lag of such a PDP, an example, in which a magnesium oxide crystal layer is formed on the front-side substrate assembly as an electron-emitting layer, is disclosed in Japanese Patent Application Laid-Open (JP-A) No. 2006-59786.

SUMMARY OF THE INVENTION

The present inventors made earnest investigations, and consequently it became apparent that by a method disclosed in JP-A No. 2006-59786, there is an improvement effect of discharge time-lag when an idle period between the last discharge and the address discharge is short (approximately several milliseconds or less), but the improvement effect of discharge time-lag is extremely deteriorated when the idle period between the last discharge and the address discharge is long.

It is an object of the present invention to provide a PDP which can effectively improves the discharge time-lag even in the case where the idle period between the last discharge and the address discharge is long.

In accordance with the invention, there is provided a PDP having a discharge space between two substrate assemblies opposed to each other, wherein a priming particle-emitting layer containing magnesium oxide crystals to which a halogen element is added in an amount of 1 to 10000 ppm is placed in such a way that the priming particle-emitting layer is exposed to the discharge space.

The present inventors made earnest investigations, and consequently they found that when a layer emitting a priming particle (hereinafter, referred to as a "P particle"), containing magnesium oxide crystals (hereinafter, referred to as "MgO crystals") to which a halogen element is added in an amount of 1 to 10000 ppm, is placed in such a way that the priming particle-emitting layer is exposed to the discharge space, the improvement effect of discharge time-lag lasts for a long time and therefore, the discharge time-lag can be effectively improved even in the case where the idle period between the last discharge and the address discharge is long. These findings have now led to completion of the invention.

The reason why the improvement effect of discharge time-lag lasts for a long time in accordance with the invention is not necessarily clear, but it is estimated that the halogen element added is substituted for an oxygen element in the MgO crystal and this substituted halogen element becomes an electron trap to improve an electron-emitting characteristic.

Further, in accordance with the invention, since the improvement effect of discharge time-lag lasts for a long time, it is possible to effectively suppress the discharge time-lag in the case where the idle period is long even when an amount of the halogen element added is small, leading to a reduction in cost.

BRIEF DESCRIPTION OF THE DRAWINGS

FIG. 1A is a plan view, and FIGS. 1B and 1C are cross-sectional views taken on lines I-I and II-II in FIG. 1A;

DESCRIPTION OF THE PREFERRED EMBODIMENTS

Figure 1A:
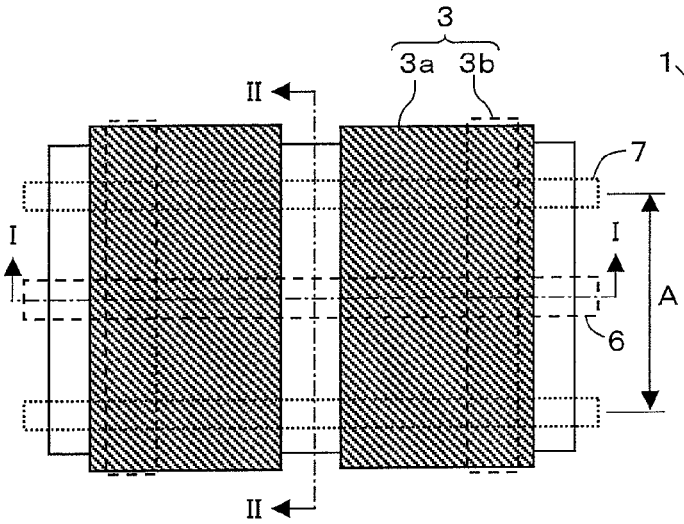
FIGS. 1A to 1C are views showing a structure of a PDP of an Example of the invention.

Hereinafter, an example of the invention will be described with reference of drawings. Configurations shown in the drawings or described below are only examples and accordingly, the invention is not to be considered as being limited by the drawings or the following descriptions. In the following example, the invention will be explained by exemplifying reflection type three electrode surface-discharge PDPs, but the invention can also be applied to another type of PDP. For example, the invention can also be applied to transmission-type PDPs in which the configuration is inverted between the front-side and the rear-side, or PDPs different in the number of electrodes, electrode arrangements or discharge types.

Figure 1C:
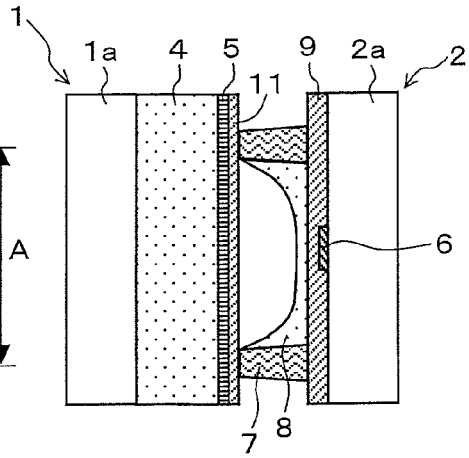
Figure 1B:
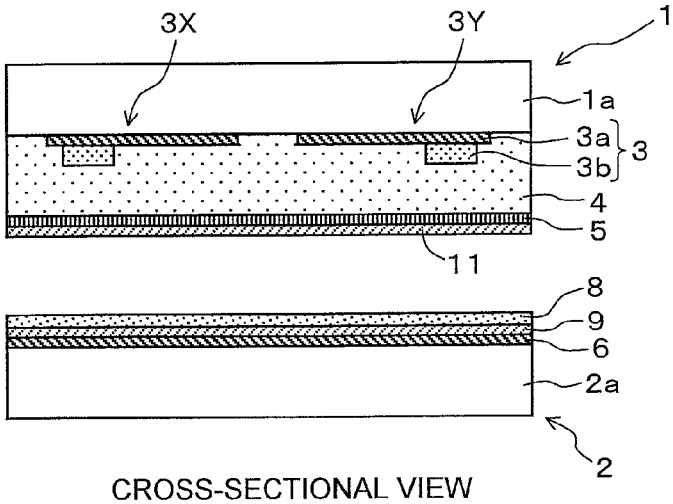

FIGS. 1A to 1C are views showing a structure of a PDP of an example of the invention, and FIG. 1A is a plan view, and FIGS. 1B and 1C are cross-sectional views taken on lines I-I and II-II in FIG. 1A.

A PDP of this example has a front-side substrate assembly 1 and a rear-side substrate assembly 2 opposed to each other. The front-side substrate assembly 1 has a front-side substrate 1*a*, a plurality of display electrodes 3 each composed of a transparent electrode 3*a* and a metal electrode 3*b* and placed on the substrate 1*a*, a dielectric layer 4 covering a plurality of display electrodes 3, a protective layer 5 placed on the dielectric layer 4, and a P particle-emitting layer 11 on the dielectric layer 4 with the protective layer 5 interposed therebetween.

The rear-side substrate assembly 2 has a rear-side substrate 1*b*, a plurality of address electrodes 6 crossing the display electrodes 3 (preferably at a right angle) and placed on the substrate 1*b*, a dielectric layer 9 covering a plurality of address electrodes 6, and barrier ribs 7 and phosphor layers 8 placed on the dielectric layer 9.

The front-side substrate assembly 1 and the rear-side substrate assembly 2 are stuck to each other at their peripheral portions, and a discharge gas (for example, a gas formed by mixing a Xe gas in an amount of about several percentages in a Ne gas), is introduced in air-tight discharge space between the front-side substrate assembly 1 and the rear-side substrate assembly 2. The air-tight discharge space is divided by the barrier ribs.

The P particle-emitting layer 11 is placed so as to be exposed to a discharge space and contains magnesium oxide crystals to which a halogen element is added in an amount of 1 to 10000 ppm.

Hereinafter, each constituent will be described in detail.

1-1. Substrate, Display Electrode, Dielectric Layer, Protective Layer (Front-Side Substrate Assembly)

The front-side substrate 1*a* is not particularly limited, and any substrate which is known in the art can be used as the substrate 1*a*. Specifically, transparent substrates such as a glass substrate, a plastic substrate and the like can be exemplified.

The display electrodes 3 may be composed of a transparent electrode 3*a* with a wide width made of materials such as ITO, $SnO_2$ and the like and a metal electrode 3*b* with a narrow width made of materials such as Ag, Au, Al, Cu, Cr, and laminates thereof (for example, Cr/Cu/Cr laminate structure) for reducing the resistance of the electrode. Shapes of the transparent electrode 3*a* and the metal electrode 3*b* are not particularly limited, and a T-shaped electrode or an electrode having a form of a ladder may be employed. The shapes of the transparent electrode 3*a* and the metal electrode 3*b* may be the same or different. For example, the transparent electrode 3*a* may be shaped like a letter T or into a ladder and the metal electrode 3*b* may have a straight form. Further, the transparent electrode 3*a* may be omitted, and in this case, the display electrodes 3 are composed of only the metal electrode 3*b*.

A pair of two electrodes of such a plurality of the display electrodes 3 compose a display line, and electrodes are placed in an array in which a non-discharge region (also referred to a reverse slit) is placed between one pair of two electrodes and another pair of two electrodes, or an array of ALIS type in which electrodes are equally spaced and all regions between neighboring electrodes become discharge regions. This pair is composed of a scan electrode 3Y and a sustain electrode 3X. The scan electrode 3Y is used for address discharge between the scan electrode 3Y and the address electrodes 6. The sustain electrode 3X is used for sustain discharge between the sustain electrode 3X and the scan electrode 3Y.

The dielectric layer 4 can be formed, for example, by applying a low melting point glass paste onto a substrate with the display electrodes 3 thereon by a screen printing method, and firing the paste. The paste is formed by adding a binder and a solvent to low melting point glass frit. The dielectric layer 4 may also be formed by depositing silicon oxide on a substrate with the display electrodes 3 thereon by a CVD process or the like.

The protective layer 5 is made of metal (more specifically, divalent metal) oxide such as magnesium oxide, calcium oxide, strontium oxide or barium oxide, and the protective layer 5 is preferably made of magnesium oxide. The protective layer 5 is formed by a vapor deposition method, a sputtering method or an application method.

1-2. Substrate, Address Electrode, Dielectric Layer, Barrier Rib, Phosphor Layer (Rear-Side Substrate Assembly)

The rear-side substrate 2*a* is not particularly limited, and any substrate which is known in the art can be used as the substrate 2*a*. Specifically, transparent substrates such as a glass substrate, a plastic substrate and the like can be exemplified.

The address electrodes 6 may be composed of metals such as Ag, Au, Al, Cu, Cr, and laminates thereof (for example, Cr/Cu/Cr laminate structure).

The dielectric layer 9 can be formed with the same material and by the same method as in the dielectric layer 4.

The barrier ribs 7 can be formed by forming a layer of a barrier rib-forming material such as a glass paste having a low melting point on the dielectric layer 9, patterning this layer of a barrier rib-forming material by sandblasting or the like, and firing the layer. The barrier ribs 7 may be formed by a method other than this method. The shapes of the barrier ribs 7 are not limited, and an electrode having the form of, for example, a stripe, a meander, a lattice or a ladder may be employed.

The phosphor layers 8 can be formed, for example, by applying a phosphor paste containing phosphor powder and a binder to an inside of a groove between neighboring barrier ribs 7 by a screen printing method or a method of using a dispenser, repeating this application for every color (R, G, B), and firing the paste.

1-3. Priming Particle (P Particle)-Emitting Layer

The P particle-emitting layer 11 is placed so as to be exposed to a discharge space and is composed of a P particle-emitting material containing MgO crystals to which a halogen element is added in an amount of about 1 to 10000 ppm.

Hereinafter, the MgO crystal to which a halogen element is added is referred to as a "halogen-containing MgO crystal" In the specification, "ppm" indicates a concentration by weight. The P particle-emitting material may contain components other than the halogen-containing MgO crystal, may contain the halogen-containing MgO crystal as a principal component, or may contain only the halogen-containing MgO crystal.

The species of the halogen element is not particularly limited. The halogen element comprises one or more species of, for example, fluorine, chlorine, bromine and iodine. It is verified that the improvement effect of discharge time-lag lasts for a long time when the halogen element is fluorine, but it is expected that the similar effect is achieved because of a similarity of an electron state also when a halogen element other than fluorine is added.

An amount of the halogen element added is not particularly limited. The amount of the halogen element added is, for example, 1 to 10000 ppm. Since it was verified that in the example, the same effect is achieved even if an amount of the halogen element added is changed within a range of 24 to 440 ppm, it is expected that the amount of the halogen element added does not largely affect the improvement effect, and therefore that the improvement effect of discharge time-lag lasts for a long time if the amount of the halogen element added is in a range of about 1 to 10000 ppm. The amount of the halogen element added is, for example, 1, 5, 10, 15, 20, 30, 40, 50, 60, 70, 80, 90, 100, 120, 140, 160, 180, 200, 250, 300, 350, 400, 450, 500, 600, 700, 800, 900, 1000, 1500, 2000, 3000, 4000, 5000, 6000, 7000, 8000, 9000 or 10000 ppm. The amount of the halogen element added may be in the range between any two of numerals exemplified above. The amount of the halogen element added can be measured by a combustion-ion chromatography analysis.

A method for producing the halogen-containing MgO crystals is not particularly limited. As an example, the halogen-containing MgO crystals can be produced by mixing the MgO crystals with a halogen-containing substance, firing the resulting mixture, and pulverizing the fired mixture. The MgO crystals will be described later. Examples of the halogen-containing substance include a halide of magnesium (magnesium fluoride etc.) and halides of Al, Li, Mn, Zn, Ca, and Ce. Firing is preferably performed at temperatures of 1000 to 1700° C. A firing temperature is, for example, 1000, 1100, 1200, 1300, 1400, 1500, 1600 or 1700° C. The firing temperature may be in the range between any two of numerals exemplified above. A method of pulverizing the fired substance is not particularly limited, and examples of the method include a method in which the fired substance is placed in a mortar and is ground down into powder with a pestle.

The halogen-containing MgO crystals are preferably of powder form, and a size and shape thereof are not particularly limited, but an average particle diameter is preferably in a range from 0.05 to 20 μm. If the average particle diameter of the halogen-containing MgO crystals is too small, the effect of improving the discharge time-lag becomes slight and if the average particle diameter is too large, the P particle-emitting layer 11 is difficult to be uniformly formed.

The average particle diameter of the halogen-containing MgO crystals can be calculated according to the following equation.

Equation: average particle diameter$=a/(S\times\rho)$ (In the equation, "a" denotes a shape coefficient and 6, "S" denotes a BET specific surface area measured by the nitrogen absorption method, and "ρ" denotes a true density of halogen-containing MgO crystals.)

The average particle diameter of the halogen-containing MgO crystals may be specifically 0.05, 0.1, 0.2, 0.3, 0.4, 0.5, 0.6, 0.7, 0.8, 0.9, 1, 2, 3, 4, 5, 6, 7, 8, 9, 10, 11, 12, 13, 14, 15, 16, 17, 18, 19, and 20 μm. The range of the average particle diameter of the halogen-containing MgO crystals may be in the range between any two of numerals specifically exemplified above.

Next, the MgO crystals to be used for producing the halogen-containing MgO crystals will be described. The MgO crystal has a characteristic of generating light emission by cathode luminescence exhibiting the peak in a wavelength region from 200 to 300 nm by irradiation of electron beams. The MgO crystals are preferably of powder form, and the size and the shape thereof are not particularly limited, but the average particle diameter is preferably in a range from 0.05 to 20 μm.

The average particle diameter of the MgO crystals can be calculated according to the following equation.

Equation: average particle diameter$=a/(S\times\rho)$ (In the equation, "a" denotes a shape coefficient and 6, "S" denotes a BET specific surface area measured by the nitrogen absorption method, and "ρ" denotes a true density of MgO crystals.)

The average particle diameter of the MgO crystals may be specifically 0.05, 0.1, 0.2, 0.3, 0.4, 0.5, 0.6, 0.7, 0.8, 0.9, 1, 2, 3, 4, 5, 6, 7, 8, 9, 10, 11, 12, 13, 14, 15, 16, 17, 18, 19, and 20 μm. The range of the average particle diameter of the MgO crystals may be in the range between any two of numerals specifically exemplified above.

A method for producing the MgO crystals is not particularly limited, however it is preferable to produce the MgO crystals by a vapor-phase process involving a reaction of magnesium vapor with oxygen and, for example, the production may be carried out specifically by a method described in JP-A No. 2004-182521 and a method described in "Synthesis of Magnesia Powder by Vapor Phase Method and Its Properties" in "Material" vol. 36, no. 410, pp. 1157-1161, on November (1987). Further, the MgO crystals may be bought from Ube Material Industries, Ltd. It is preferable to produce the crystals by a vapor-phase process since single crystals with high purity can be obtained by this process.

The P particle-emitting layer 11 can be placed directly on the dielectric layer 4 or with another layer interposed therebetween. In FIG. 1, the P particle-emitting layer 11 is placed on the dielectric layer 4 with the protective layer 5 interposed therebetween. The constitution of FIG. 1 is just one example, the P particle-emitting layers 11 may be placed somewhere in the discharge spaces so as to be exposed to the discharge spaces between the front-side substrate assembly 1 and the rear-side substrate assembly 2. If the P particle-emitting layers 11 are placed somewhere in the discharge spaces, the discharge time-lag is improved by the P particle from the P particle-emitting layer 11. It is preferable to expose the whole P particle-emitting layers 11 to the discharge spaces, but only a part of the P particle-emitting layers 11 may be exposed.

For example, the P particle-emitting layer 11 may be placed on the front-side substrate assembly 1 or on the rear-side substrate assembly 2. When the P particle-emitting layer 11 is placed on the front-side substrate assembly 1, the protective layer 5 may be omitted to place the P particle-emitting layer 11 on the dielectric layer 4, or the protective layer 5 with an opening may be placed on the dielectric layer 4 and the P particle-emitting layer 11 may be placed in this opening.

Thickness or shape of the P particle-emitting layer 11 is not particularly limited. The P particle-emitting layer 11 may be placed through the area in the display region or at only a part of the display region. For example, the P particle-emitting layer 11 may be formed only in regions where the P particle-emitting layer 11 overlaps the display electrodes 3 in a plan view, or only in regions where the P particle-emitting layer 11 overlaps the scan electrodes 3Y in a plan view. In this case, it is possible to reduce usage of the P particle-emitting material with little reduction in the improvement effect of discharge time-lag. Further, the P particle-emitting layer 11 may be formed only in regions where the P particle-emitting layer 11 overlaps the metal electrode 3*b* or only in regions where the P particle-emitting layer 11 overlaps the non-discharge line (reverse slit) between display electrode-pairs in which surface-discharge does not occur. In this case, it is possible to suppress the reduction in brightness due to formation of the P particle-emitting layer 11. The P particle-emitting layer 11 may be formed so as to have a straight form or in the form of isle separated in every discharge cell.

A method of forming the P particle-emitting layer 11 is not particularly limited. The P particle-emitting layer 11 can be formed, for example, by spraying a powdery P particle-emitting material as it is or in a state of being dispersed in a dispersion medium on the protective layer 5. Alternatively, the P particle-emitting material may be attached to the protective layer 5 by screen printing. Further, the P particle-emitting layer 11 may be formed by attaching a paste or a suspension including the P particle-emitting material to a site where the P particle-emitting layer 11 is formed by use of a dispenser or an ink-jet system.

EXAMPLE

Hereinafter, a specific example of the invention will be described. In the following example, the improvement effect of discharge time-lag by placing MgO crystals to which fluorine is added so as to be exposed to the discharge space was investigated. Further, the example was compared with the case where usual MgO crystals to which fluorine is not added are placed so as to be exposed to the discharge space crystals. Hereinafter, MgO crystals to which fluorine is added are referred to as "F-containing MgO crystals"

1. Method for Producing F-Containing MgO Crystals 5 species of F-containing MgO crystals (referred to as example samples A to E), having different amounts of F added, were prepared by the following method.

First, agglomerated MgO crystals (produced by Ube Material Industries, Ltd., trade name: HIGH PURITY & ULTRAFINE SINGLE CRYSTAL MAGNESIA POWDER manufactured by a oxidation process of magnesium vapor (2000A)) and agglomerated $MgF_2$ (produced by Furuuchi Chemical Corporation, purity: 99.99%) were respectively pulverized into powder with a mortar and a pestle.

Next, the pulverized MgO crystals and $MgF_2$ were weighed out so as to become the amount of $MgF_2$ mixed shown in Table 1 and they were mixed in a tumbler mixer.

Next, the resulting mixture was fired at 1450° C. for 1 hour in the air.

Next, the fired mixture was pulverized into powder to obtain F-containing MgO crystals of example samples A to E.

Figure 2:
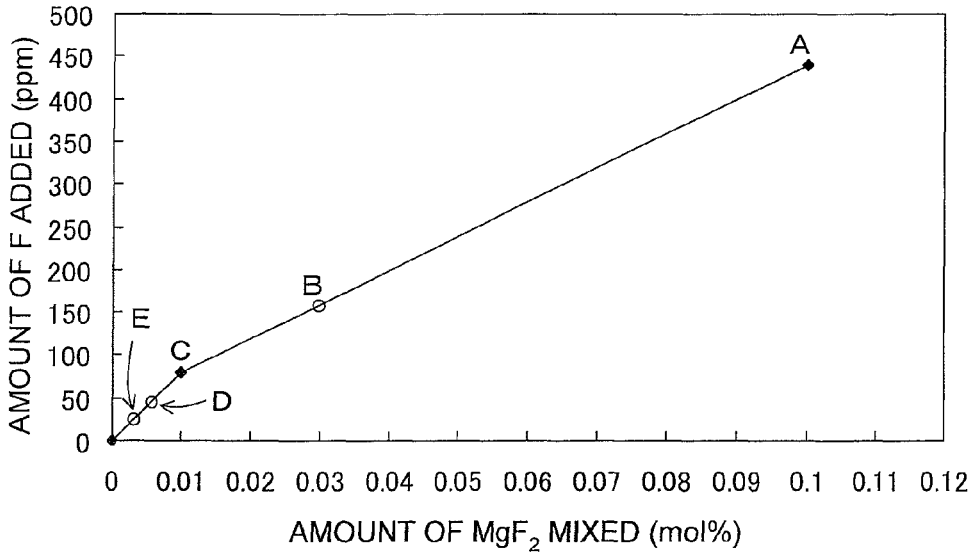
FIG. 2 is a graph for determining estimated values of amounts of F added of samples B, D, and E in an example of the invention.

Next, amounts of F added of example samples A and C were measured by a combustion-ion chromatography analysis. The results of measurements are shown in Table 1. Further, estimated values of amounts of F added of example samples B, D, and E, which are predicted from the measurements of the amounts of F added of example samples A and C, were determined from a graph of FIG. 2. In Table 1, the estimated value of amount of F added is indicated in parentheses.

TABLE 1

| Name | Amount of $MgF_2$ mixed (mol %) | Measurement (estimation) of an amount of F added (ppm) |
|---|---|---|
| Example sample A | 0.1 | 440 |
| Example sample B | 0.03 | (160) |
| Example sample C | 0.01 | 80 |
| Example sample D | 0.006 | (48) |
| Example sample E | 0.003 | (24) |

2. Method for Producing PDP

Next, a PDP having a P particle-emitting layer 11 consisting of the F-containing MgO crystals of the example sample A, B, C, D or E was prepared according to the following method. Further, a PDP was prepared by the same method and under the same conditions using MgO crystals (produced by Ube Material Industries, Ltd., trade name: HIGH PURITY & ULTRAFINE SINGLE CRYSTAL MAGNESIA POWDER manufactured by the oxidation process of magnesium vapor (2000A)) to which F is not added in place of the F-containing MgO crystals in order to use for a comparative example in a discharge time-lag test described later.

2-1. General Outline

As shown in FIGS. 1A to 1C, a front-side substrate assembly 1 was prepared by forming display electrodes 3, a dielectric layer 4, a protective layer 5, and a P particle-emitting layer 11 on a glass substrate 1*a*. Further, a rear-side substrate assembly 2 was prepared by forming address electrodes 6, a dielectric layer 9, barrier ribs 7, and phosphor layers 8 on a glass substrate 2*a*. Next, a panel having internal air-tight discharge spaces was prepared by overlaying the front-side substrate assembly 1 on the rear-side substrate assembly 2 and sealing these assemblies at their peripheral portions with a sealing material. Next, after evacuating the insides of the discharge spaces, a discharge gas was introduced into the discharge spaces to complete a PDP.

2-2. Method of Forming P Particle-Emitting Layer

Specifically, the P particle-emitting layer 11 was formed according the following method.

First, the F-containing MgO crystals was mixed in the rate of 2 gram with respect to 1 litter with IPA (produced by KANTO CHEMICAL Co., Inc, for the electronics industry), and the resulting mixture was dispersed with an ultrasonic dispersing machine and thereby agglomerates are pulverized to prepare slurry.

Next, the above-mentioned slurry was spray-applied onto the protective layer 5 with a coating spray gun, and then a step of drying through a blow of dry air was repeated several times to form a P particle-emitting layer 11. The P particle-emitting layer 11 was formed in such a way that a weight of the F-containing MgO crystals is 2 g per 1 $m^2$ of the layer.

2-3. Others

Other conditions are as follows.

Front-Side Substrate Assembly 1:

Width of display electrodes 3*a*: 270 μm

Width of metal electrode 3*b*: 95 μm

Width of discharge gap: 100 μm

Dielectric layer 4: formed by applying a glass paste having a low melting point and firing the paste, thickness: 30 μm Protective layer 5: MgO layer by electron beam deposition, thickness: 7500 Å

Rear-Side Substrate Assembly 2:

Width of address electrodes 6: 70 μm

Dielectric layer 9: formed by applying a glass paste having a low melting point and firing the paste, thickness: 10 μm Thickness of a portion, directly above address electrodes 6, of phosphor layers 8: 20 μm Material of phosphor layers 8: $Zn_2SiO_4$: Mn (green-emitting phosphor)

Figure 3:
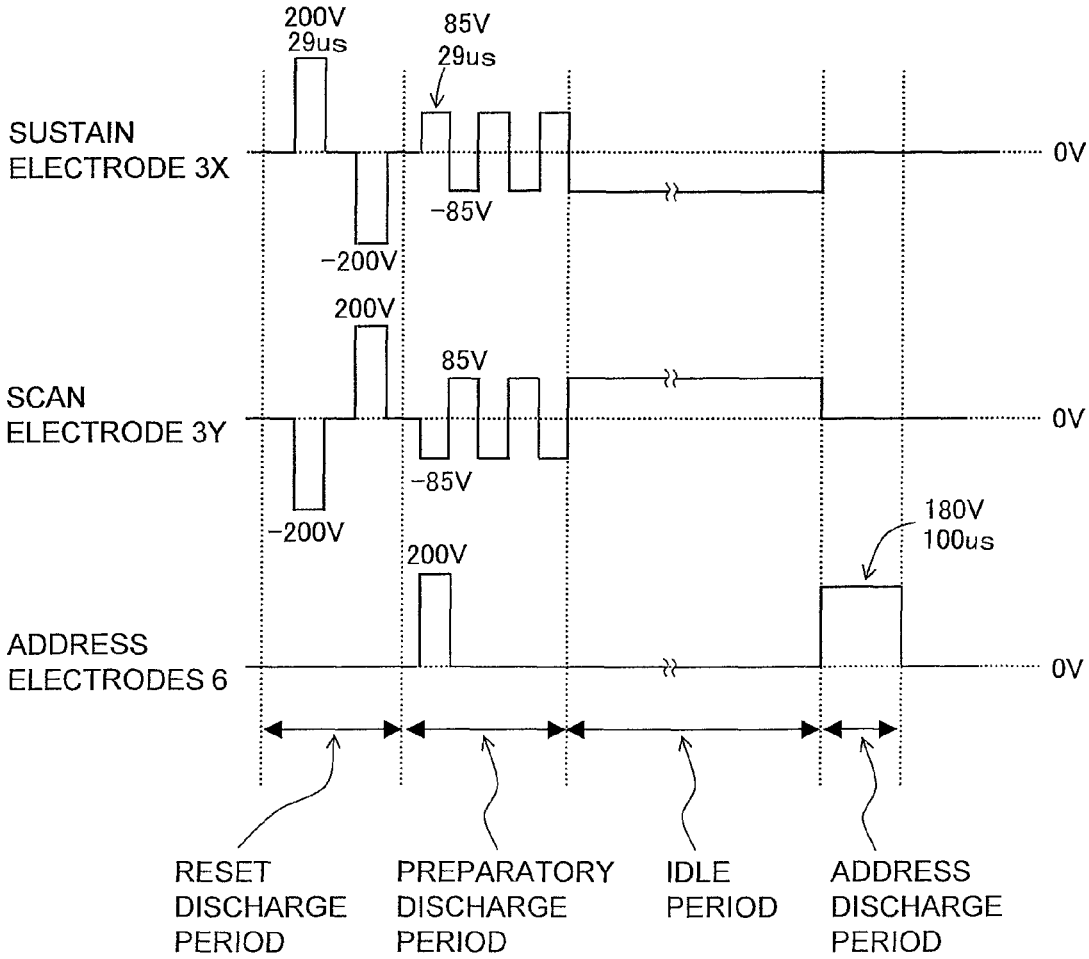
FIG. 3 is a view showing voltage waveforms used for measuring a discharge time-lag in the example of the invention.

Height of barrier ribs 7: 140 μm Width at an apex of barrier ribs 7: 50 μm Pitch of barrier ribs 7 (dimension A in FIG. 1A): 360 μm Discharge gas: Ne 96%-Xe 4%, 500 Torr 3. Discharge Time-Lag Test Next, a discharge time-lag test was performed on each PDP produced. The discharge time-lag test was carried out using voltage waveforms for measurement shown in FIG. 3. In a reset discharge period, reset discharge was generated between the sustain electrode 3X and the scan electrode 3Y to reset a charge state of the dielectric layer and thereby an influence of previous discharge was eliminated. In a preparatory discharge period, after selecting a specific cell, discharge was generated between the sustain electrode 3X and the scan electrode 3Y to excite the P particle-emitting material. Thereafter, after a lapse of 10 μs to 50 ms of an idle period, voltage was applied to the address electrodes 6 in an address discharge period and the time elapsed between application of voltage and an actual initiation of discharge was measured. This elapsed time was measured 1000 times and the time at which cumulative probability of discharge reaches 90% is defined as a discharge time-lag.

Figure 4:
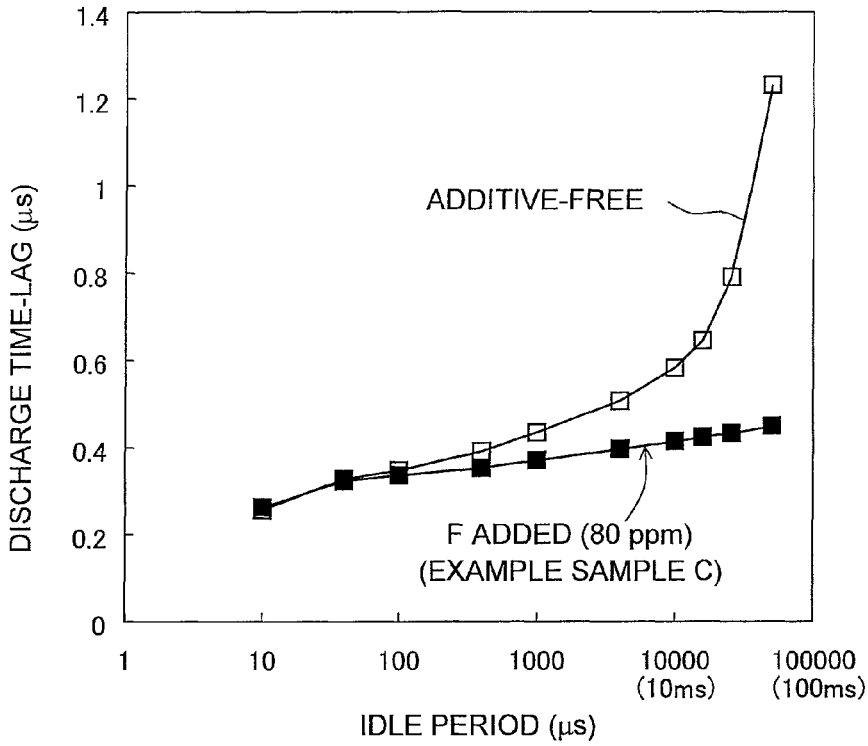
FIG. 4 is a graph showing a relationship between an idle period and a discharge time-lag in a PDP produced by use of a sample C of the example and a PDP produced by use of additive-free MgO crystals.
Figure 5:
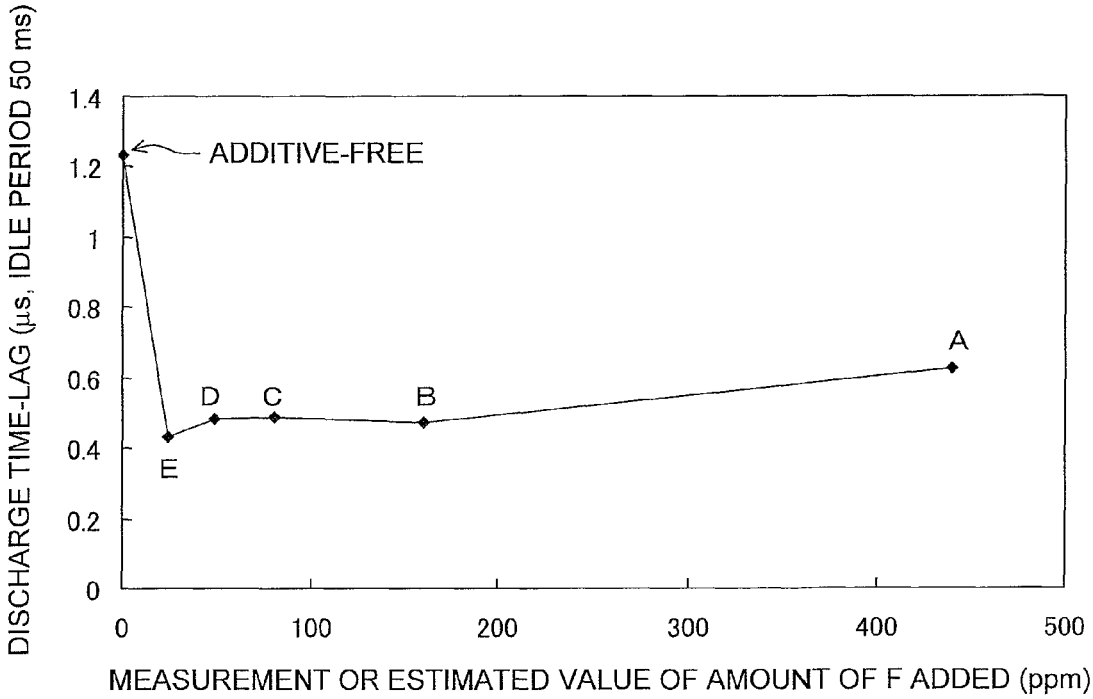
FIG. 5 is a graph showing a relationships between a measurement or an estimated value of an amount of F added and a discharge time-lag of the example of the invention.
Figure 6:
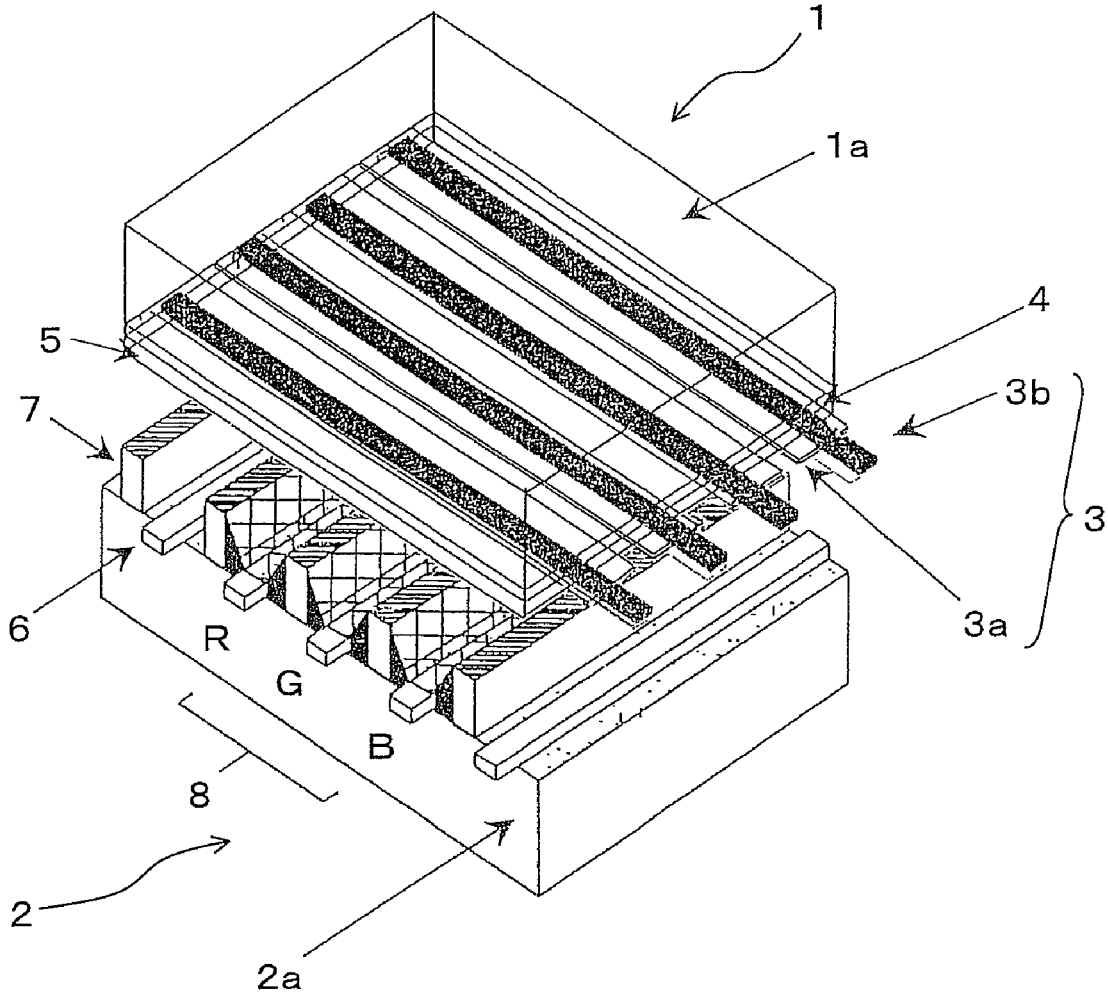
FIG. 6 PRIOR ART
FIG. 6 is a perspective view showing a conventional PDP structure.

Results thus obtained are shown in Table 2, and FIGS. 4 and 5. FIG. 4 is a graph showing a relationship between an idle period and a discharge time-lag in a PDP produced by use of an example sample C and a PDP produced by use of additive-free MgO crystals. FIG. 5 is a graph on which the data in Table 2 are plotted.

TABLE 2

| Name | Measurement (estimation) of an amount of F added (ppm) | Discharge time-lag (μs, idle period 50 ms) |
|---|---|---|
| Example sample A | 440 | 0.622 |
| Example sample B | (160) | 0.474 |
| Example sample C | 80 | 0.485 |
| Example sample D | (48) | 0.484 |
| Example sample E | (24) | 0.431 |
| additive-free MgO crystals | 0 | 1.231 |

As is apparent from FIG. 4, it is found that in the PDP produced by use of the example sample C, a discharge time-lag is small even in a region of a long idle period compared with the PDP produced by use of additive-free MgO crystals. This means that the F-containing MgO crystals such as the example sample C keep an effect of inhibiting a discharge time-lag for a longer time than the additive-free MgO crystals.

Also, as is apparent from Table 2 and FIG. 5, it is found that a change in discharge time-lag is small in a range of an amount of F added of 24 to 440 ppm. This shows that the amount of a fluorine element added does not have a large influence on the improvement effect of discharge time-lag, and this is thought to suggest that the improvement effect of discharge time-lag lasts for a long time when the amount of F added is in a range of about 1 to 10000 ppm.

What is claimed is:

1. A plasma display panel comprising a discharge space between two substrate assemblies opposed to each other, in which one of the substrate assemblies comprises display electrodes on a substrate, a dielectric layer covering the display electrodes, a protective layer of magnesium oxide covering the dielectric layer, and a priming-particle emitting layer on the protective layer and exposed to the discharge space, wherein the priming-particle emitting layer is composed of a material different from the protective layer and contains magnesium oxide crystals of powder form to which a halogen element is added in an amount of at least 24 ppm to no greater than 440 ppm, and the magnesium oxide crystals of powder form generate light emission by cathode luminescence exhibiting a peak in a wavelength region of 200 to 300 nm by irradiation of electron beams.

2. The plasma display panel of claim 1, wherein the halogen element is fluorine.

3. The plasma display panel of claim 1, wherein the halogen element is added to the magnesium oxide crystals in powder form in the amount of at least 24 ppm and no greater than 100 ppm.

4. The plasma display panel of claim 1, wherein the average particle diameter of the magnesium oxide crystals of powder form is in a range from 0.05 to 20 μm.

5. The plasma display panel of claim 1, wherein the priming-particle emitting layer is placed at only a part of the display region of the plasma display panel.

6. The plasma display panel of claim 1, wherein the priming-particle emitting layer is formed only in regions where the priming-particle emitting layer overlaps the display electrodes of the plasma display panel.

7. The plasma display panel of claim 1, wherein the protective layer is one of a vapor deposited protective layer, a sputtered protective layer and an applied protective layer.

* * * * *